United States Patent [19]

Ueno et al.

[11] 4,378,753

[45] Apr. 5, 1983

[54] DEVELOPING APPARATUS FOR AN IMAGE REPRODUCTION

[75] Inventors: Kenji Ueno; Yoshio Ymazaki, both of Hachioji, Japan

[73] Assignee: Konishiroku Photo Industry Co., Ltd., Japan

[21] Appl. No.: 265,418

[22] Filed: May 19, 1981

[51] Int. Cl.[3] ..... G03G 15/09

[52] U.S. Cl. ..... 118/657; 118/658

[58] Field of Search ..... 118/657, 658

[56] References Cited

U.S. PATENT DOCUMENTS

| | | | |
|---|---|---|---|
| 3,552,355 | 1/1971 | Flint | 118/627 |
| 4,237,819 | 12/1980 | Ikegami et al. | 118/658 |
| 4,292,922 | 10/1981 | Yamazaki et al. | 118/657 |

*Primary Examiner*—Bernard D. Pianalto

*Attorney, Agent, or Firm*—Jordan B. Bierman; Linda Bierman

[57] ABSTRACT

In an electrophotographic copying machine of the type utilizing a single-component developer applied to a photosensitive member through the use of a magnetic brush; a regulating plate is positioned across the sleeve of the brush immediately prior to the juxtaposition of the sleeve and the photosensitive member in order to prevent spill-over of excess magnetic toner. This plate is preferably in addition to another regulating plate placed across the sleeve upstream of the first regulating plate where the developer is fed to the sleeve. Both plates have wider outer edges closely spaced to the sleeve to prevent rising of the developer over these outer edges when the magnetic force of the brush is weak and does not hold the developer to the sleeve.

3 Claims, 8 Drawing Figures

DEVELOPING APPARATUS FOR AN IMAGE REPRODUCTION

BACKGROUND OF THE INVENTION

1. Field of the Invention

The present invention relates to a developing apparatus for an image reproduction such as electrophotographic apparatus, facsimile and the like.

2. Description of the Prior Art

In electrophotographic apparatus, for example, a reproduction image is obtained in such a manner that a uniformly electrostatically charged photoreceptor is imagewise exposed to the light reflected from a document to be reproduced and to form thereonto an electrostatic latent image corresponding to the document, the electrostatic latent image being developed by a developer to a visible image, which is then fixed as it is, or is transferred onto a recording paper and then fixed. The developer is stored in a developer container, inside which is disposed a cylindrical sleeve consisting of a nonmagnetic material which is partially immersed in the developer and is in close proximity to the surface of the photosensitive body. Inside the sleeve a plurality of magnets are disposed with a given space apart from each other in close proximity to the interior of the sleeve, and the sleeve and the group of the magnets are mounted so that they are relatively rotatable. The sleeve and the group of the magnets together form a developing means, and with the rotation of either, said sleeve or the group of the magnets, the developer inside the said container is transported along the surface of the sleeve and is then brought into contact with the surface of the photoreceptor, thereby forming a visible image on said photoreceptor. The developer, at the time of being transported from the developer container, is held to a given height by a regulating plate extending axially along and substantially adjacent the sleeve surface. Such type of developing apparatus is known as magnetic brush type developing apparatus.

Most electrophotographic copying apparatus now widely used employs a developer composed of a magnetic powder called "carrier" and colored resin particles called a "toner", and such a developer is called a "two-component developer". In contrast to this, a different developer consisting of toner alone, the so-called one-component developer, has emerged, which consists of a magnetic toner, a resin containing a magnetic material and, if needed, a coloring agent. This developer has many advantages such that there occurs no such change in the reproduced image density according to the consumption of toner as in the case of the two-component developer, nor need of toner replenishment according to such change, nor deterioration of the carrier, thus requiring no density detector nor special toner replenishing means, nor change of carrier, whereupon the developing apparatus itself can be of a compact type. For this reason, the one-component developer is gradually being made a practical reality.

A two-component developer is normally composed of carrier particles consisting of a magnetic material with a large particle diameter of from 50 to 200μ and fine toner particles with a particle diameter of from 5 to 20μ. As the magnetic material for the carrier, iron powder is used. The mixing proportion of the toner to the carrier is about 2 to 10% by weight.

In such a two-component developer, with the rotation of a developing means provided therein with a group of magnets, the iron powder carrier is transported by the action of the foregoing group of magnets, but the toner, because of being strongly electrically attracted to and about the iron powder carrier, is transported together with the carrier, so that the toner is only slightly scattered in the course of being transported, a little flowing out through a small opening because of the large weight of the carrier with the large particle diameter.

In contrast to this, the one-component developer has no such large diameter particles as corresponding to that of the foregoing two-component developer and is really a toner having the particle diameter of from 5 to 20μ.

Where such a one-component developer is used in a magnetic brush type developing apparatus, the developer is scattered and flies high like a mist, which contaminates the inside or outside of the apparatus or intrudes into the rotary bearing of the sleeve or the group of the magnets to increase the load of their rotation, thus sometimes scoring or burning the supporting shaft or bearing. The one-component developer, because of having a small content ratio of the magnetic material component, is fairly weak in its adherence to the sleeve. Therefore, although being compensated by the increased magnetic force of the group of the magnets, as strong adherence as that of two-component developers cannot be obtained, so that the thickness of the developer layer formed on the sleeve becomes as thin as from 1 to 2 mm, thus necessitating a fairly small gap between the regulating plate and the sleeve. Since the magnetic forces which retains the magnetic toner on the sleeve have a tangential component at the sleeve-axial magnet holding end and the magnetic force is small, the layer of developer transported being height-controlled through the small gap spreads out and rises as ears at both ends of the control plate, thus having a bad influence upon the subsequent developing effects.

For this reason, U.S. Pat. No. 4,292,922, issued Oct. 6, 1981 to co-inventors Yoshio Yamazaki, Ninichi Kamogawa and Yasuyuki Iwai, describes the prevention of such large rise of the developer by providing a partition plate and a partition auxiliary plate at both axial ends on the sleeve, and a regulating plate. However, we have found as a result of our experiments that the developer, after being transported out through the slight gap between the surface of the sleeve and these partition plates, partition auxiliary plates or regulating plates, rises again during the period until it reaches the developing section. The rise of the developer, although not so large (only 0.25 to 0.5 mm higher than the average portion) during the time of being transported on the rotating sleeve, becomes several times higher (becoming 1 to 2 mm higher than the average portion) at the point of earing when it has arrived at the developing section, thus coming into strong contact with the photosensitive body, accelerating the deterioration of the photoreceptor, bringing about a blank area or fog on the image, and/or causing the deterioration of the image quality.

SUMMARY OF THE INVENTION

The present invention has been made in view of the above problem and especially useful in the case where developer is applied to a magnetic brush type developing apparatus wherein the height of the developer transported by the rotary sleeve of the developing apparatus is controlled by a regulating plate for regulating the height of the layer of developer adhering, and is further regulated by a regulating plate for regulating the height of the layer of developer adhering which is disposed at the side downstream in the direction of the moving developer from the first regulating plate to prevent the developer from rising at both axial ends of the sleeve.

DESCRIPTION OF THE PREFERRED EMBODIMENT

In the present invention, in addition to the basic components, partition plates are preferably provided in close proximity to the surface at both axial ends of the sleeve of the developing means, the thickness of the partition plates being from 0.15 to 1.0 mm, the gap with the surface of the sleeve being 0.35 mm or smaller. In the case where the partition plates are not in contact with surface of the sleeve, it is preferred that partition auxiliary plates be provided in contact with the partition plates, and the gap between the partition auxiliary plates and the surface of the sleeve be 0.35 mm or smaller.

The present invention is illustrated in its preferred embodiment with reference to the accompanying drawings.

Figure 1:
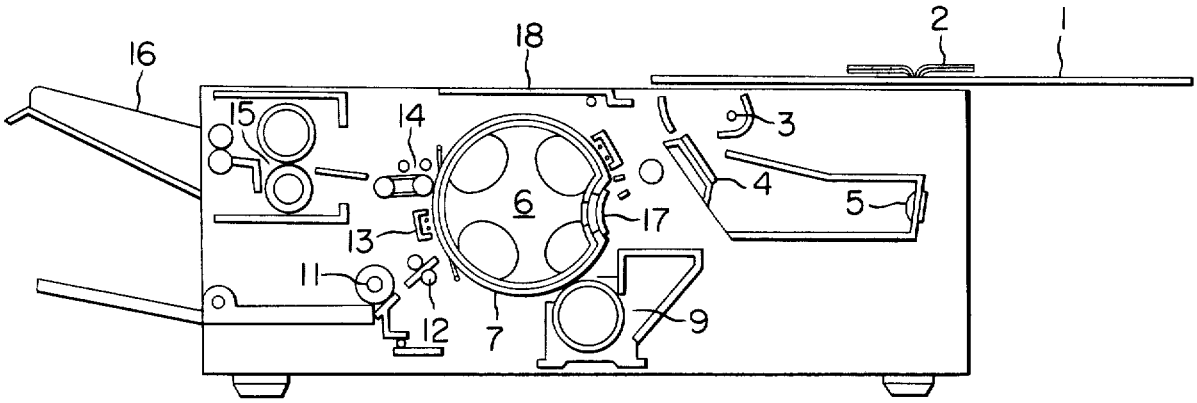
FIG. 1 of the accompanying drawings is a conceptual view showing the composition of an example of electrophotographic copying apparatus which utilizes image reproducing developing means of the present invention.

For a better understanding of the present invention, FIG. 1 first shows the outline of a moving platen type image transfer electrophotographic copying apparatus employing the developing apparatus of the present invention.

In the FIG. 1, document 2 placed on movable glass plate 1 is exposed to the light from light source 3 during its time of movement together with the movement of said glass plate 1. The light reflected from document 2 is projected by reflex mirror 4 and lens 5 onto a sheet-form photosensitive member 7 extending over rotary drum 6. The photosensitive member 7 is, in advance, uniformly electrostatically charged by charging electrode 8, and when the photosensitive member receives the light reflected from document 2, an electrostatic latent image corresponding to that of the document is formed on the surface thereof. The electrostatic latent image is developed by developing means 9 to become a visible image (toner image), which is then transferred by the action of transfer electrode 13 onto a recording paper supplied by a paper feeding roller 11 and registration rollers 12 from paper-feed tray 10. The toner image-bearing recording paper is then separated from rotary drum 6 to be transported by paper transport means 14 to fixing means 15 to be fixed therein, thus becoming a finished copy to be ejected onto paper ejecting tray 16.

Photosensitive member in the sheet form 7 is extended over with both side edges thereof attached to the external peripheral surface of rotary drum 6 by means of fixing plate 17, after being used for a given number of copyings, it is manually replaced by the operator opening the apparatus' top lid 18 provided above the rotary drum.

Figure 2:
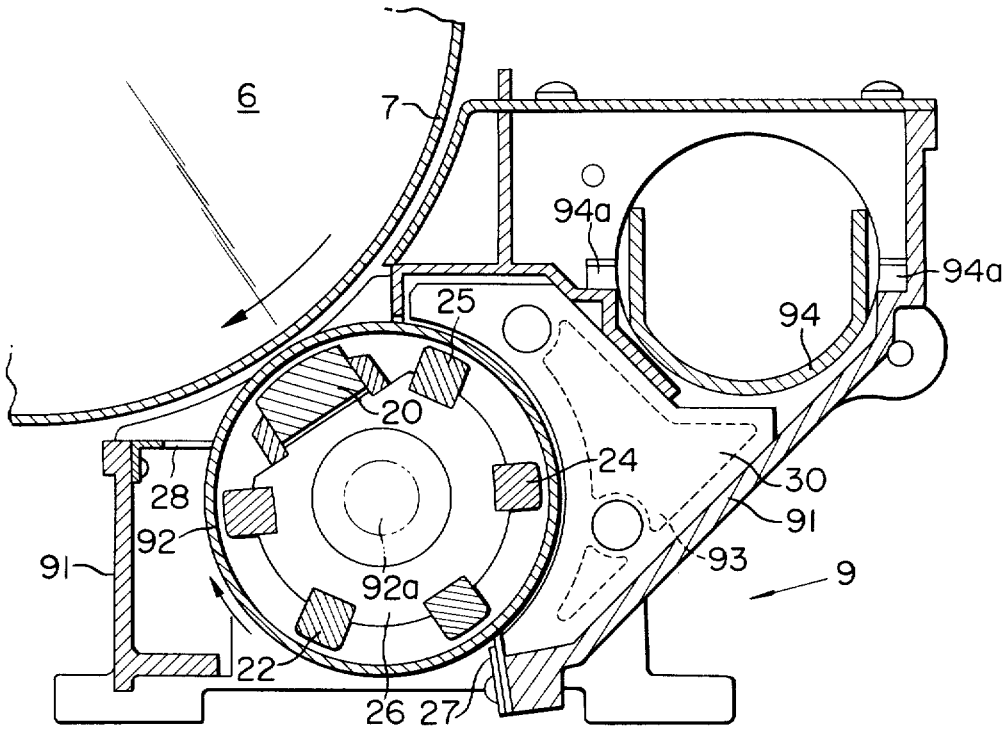
FIG. 2 is an enlarged sectional view of the image reproducing developing means of the present invention.
Figure 4:
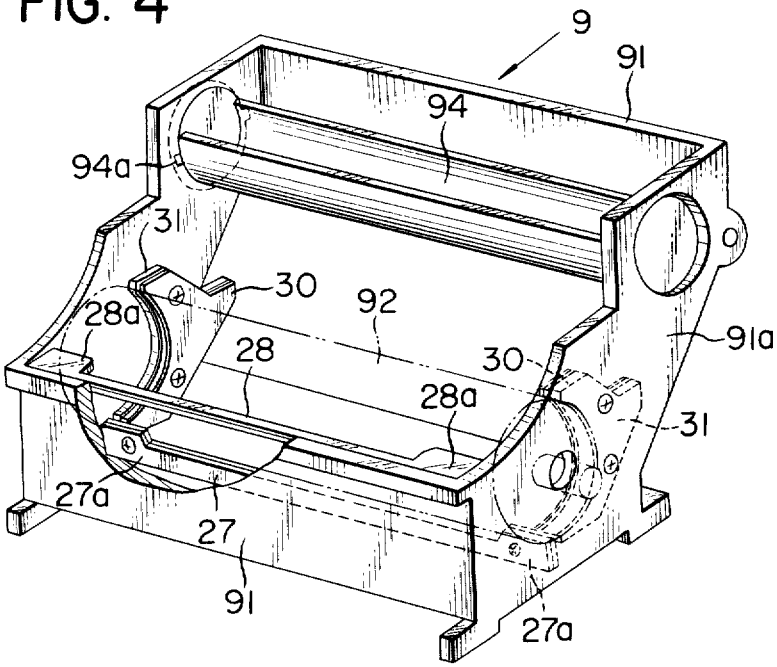
FIG. 4 is a perspective view showing the key portion of the present invention.

FIG. 2 is an enlarged sectional view showing the developing means of the present invention. FIG. 4 is a perspective view showing the key portion involved in the present invention in the developing means.

Figure 7:
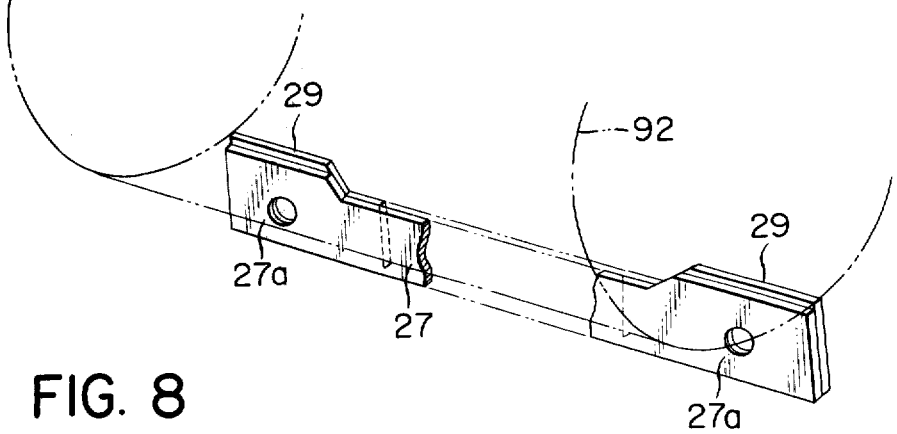
FIG. 7 is a perspective view showing the composition of the first regulating plate used in the developing means of the present invention.

Developing means 9 shown in the drawings is of a magnetic brush type, disposed in the proximity of rotary drum 6. Inside a developing brush casing 91, a nonmagnetic and conductive sleeve 92 is rotatably supported in close proximity to photosensitive sheet 7 on drum 6. Inside rotatable sleeve 92, a principal developing magnet 20 and five auxiliary magnets 21, 22, 23, 24 and 25 are mounted on support 26 each facing each other in close proximity to the inside periphery of sleeve 92, the said magnets and said support all being stationary. The polarities of these magnets are disposed alternately with N and S. Inside casing 91 a space for storing the developer; i.e., developer chamber 93 is provided on the side opposite to photosensitive member 7. Beneath rotatable sleeve 92 is provided a first regulating plate 27 fixed by suitable means such as screws to a portion of casing 91. The first regulating plate 27, as seen from FIG. 7, is a thin plate of almost the same length as the axial length of rotary sleeve 92, and is so formed slightly wider at both ends. The wider portions **27*a* are adjacent the magnetic toner-free portion of and in close proximity to sleeve 92, or provided together with the hereinafter described auxiliary members in contact with sleeve 92**, whereby developer can be prevented from leaking at the ear-forming portion and also from the rise at both ends of the regulating plate.

Figure 3:
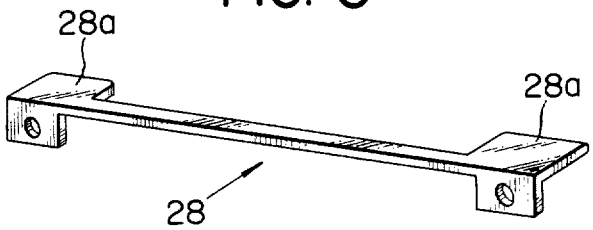
FIG. 3 is a perspective view of an example of the second regulating control plate used in the developing means of the present invention.

On the other hand, in accordance with the present invention a second regulating plate 28 is also disposed above rotary sleeve 92 by being attached as by screws to a portion of casing 91. The second regulating plate 28 is a thin nonmagnetic metal or resin plate, and, as shown in FIG. 3, both longitudinal ends are formed so as to be wider. The greater width portions **28*a* are positioned closely adjacent to the magnetic toner-free portion of rotary sleeve 92, or may be provided together with auxiliary members in contact with the rotary sleeve as in the case of first regulating plate 27. The second regulating plate 28 is for the control and prevention of the slight but further rise of the developer whose height has been regulated by the first regulating plate 27, the further rise occurring in the course of being transported to the second regulating plate 28 by rotary sleeve 92. Second regulating plate 28 should be disposed between first regulating plate 27 and developing section A, and the second regulating plate 28** may also be one not integrated but rather separately provided on the left and right sides.

Above a developing means 9 developer replenishment cassette 94 is positioned for outside loading. Cassette 94 is a container in the form of circular arc in which a given quantity of a one-component developer is stored. The cassette is provided on the outside wall thereof with outwardly projecting supports 94a, with which the cassette is supported by casing 91. Cassette 94, when replenishment is necessary, is turned 180° by the manual operation from outside to drop the developer therein into developer chamber 93.

Figure 5:
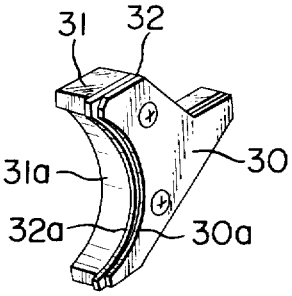
FIG. 5 is a perspective view of the assembly of the partition plate and the associate members thereof.
Figure 6:
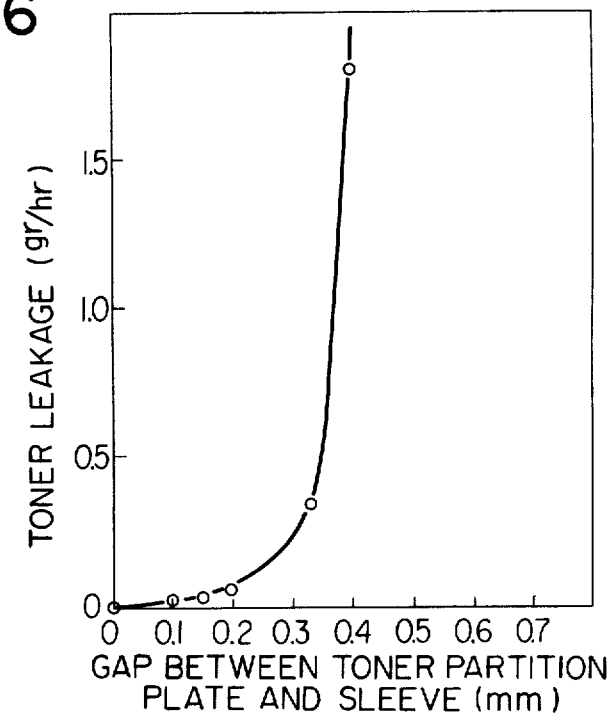
FIG. 6 is a graph showing the change in the leakage of developer with the change in the gap between the partition plate and the surface of the sleeve.

Within developer chamber 93 partition plates 30 are provided adjacent both ends of rotary sleeve 92 in order to prevent rotary sleeve 92 from a possible increase in load against the rotation thereof, or a possible burning result therefrom which arises due to the fact that the developer stored inside developer chamber 93, because of the small particle diameter, flies high like a mist inside the chamber upon rotation of rotary sleeve 92, and whereupon the developer particles come around both ends of rotary sleeve 92 to intrude into the rotary bearing (not shown), thus increasing load against the rotation or causing a burning of rotary sleeve 92. Partition plates 30 are fixed from the inside to supporting members 31 that are fixed to the inside of side walls 91a of housing 91 by means of screws applied from outside, but it is convenient to place the partition auxiliary member 32 in between the partition plate 30 and the fixing member 31 (see FIG. 5). Partition plate fixing member 31 is made of, e.g., nonmagnetic metal or nonmagnetic material such as a synthetic resin, whose concavely curved surface 31a faces the surface of rotary sleeve 92 with a given gap therebetween. Partition plate 30 is a thin plate made of a nonmagnetic material such as, e.g., phosphor bronze, whose thickness is preferred to be from 0.15 to 1.0 mm for the developer having the particle diameter of from 5 to 20μ, most preferably from 0.2 to 3.0 mm. The size of the gap between the concavely curved portion 30a of partition plate 30 and the surface of rotary sleeve 92 is important for preventing the developer from the axially leaking from both ends of the rotary sleeve; it is found to be preferably 0.35 mm or smaller as a result of our experiments. FIG. 6 shows the results of measurements on the leakages of the developer when the gap between the partition plate 30 and the surface of rotary sleeve 92 was varied (when the space between the partition plate 30 and the marginal end of magnetic toner-attaching section is set within the range of from 1 to 6 mm). From the figure it is understood that as the foregoing gap becomes more than 0.35 mm, the leakage rapidly increases. However, in actuality, there occur problems in the mass production should the gap between the partition plate 30 and the surface of rotary sleeve 92 be less than 0.35 mm, and also, for example, if the partition plate is made of phosphor bronze. Such a problem occurs from abrasion on the surface of the sleeve which is apt to be caused by the contact with the partition plate. To avoid this, partition auxiliary member 32 was put in between the partition plate 30 and fixing member 31, and the thus formed concavely curved edge 32a was brought into contact with the surface of rotary sleeve 92, whereby the problem of accuracy in the production of the gap between the partition plate and the surface of rotary sleeve 92 has been solved. Partition auxiliary member 32 is preferred to be a firm, resilient and flexible thin plate made of a nonmagnetic material such as polyimide, polycarbonate and polyester the like known in the product names as Teflon, Mylar and the like doing no harm to the surface of the sleeve even when brought into contact therewith. The thickness of auxiliary member 32 may be from 0.15 to 1.0 mm, most desirably from 0.2 to 0.3 mm. Auxiliary member 32, since the concavely curved edge 32a thereof is always in contact with the surface of rotary sleeve 92, should withstand the heat produced by the friction with rotary sleeve 92, and besides, should be wear-resistant.

On the other hand, the gap between the upper edge of the wider width portions 27a and the surface of rotary sleeve 92 is preferred to be also 0.35 mm or smaller, said wider portion being provided on both sides of the first regulating plate 27 for the prevention of the rise of developer being spread over outside both ends of the regulating plate 27 at the time when the developer with the height thereof regulated by the first regulating plate 27 is transported from developer chamber 93. However, the regulating plate, similarly to partition plate 30, is generally made of a relatively hard material such as metals, hard plastic materials and the like, so that there possibly occurs such a problem that when in contact with the sleeve, the material will do harm to the surface of the sleeve or will increase excessively the rotating torque, and in addition, if the gap between the upper edge of the wider width portions 27a of regulating plate 27 is accurately set to be 0.35 mm or smaller, it will raise some problem in the mass production of the device. Accordingly, the problem of the accuracy in setting the gap has been solved by bringing the auxiliary regulating plate 29 into close contact with the wider width portion 27a as shown in FIG. 7. Auxiliary regulating plate 29 is preferred to be made of a material having the same nature as that of auxiliary member 32, and the thickness of the plate is desired to be from 0.15 to 1.0 mm. Auxiliary regulating plate 29 has its upper edge come into contact with the surface of rotary sleeve 92.

Figure 8:
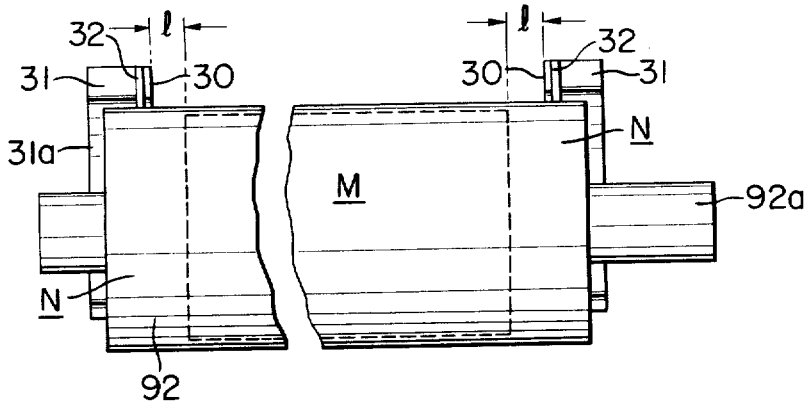
FIG. 8 is a schematic drawing provided for the illustration of the relative position of the partition plates to the sleeve.

Subsequently, we have found that the relative position of partition plate 30 to rotary sleeve 92 has large influence upon the leakage of developer. Inside rotary sleeve 92, as illustrated in detail in FIG. 2, a group of magnets 20 to 25 are provided to form a magnetic toner-attaching area M (see FIG. 8). The distance l between the end of the area M and partition plate 30 above the magnetic toner-free portion N has been found out to exert large influence upon the leakage of developer. Our experiments made on this matter showed the following results, wherein the leakage is given in the quantity in gram of developer leaking per hour:

| Distance l in mm | Leaking condition of developer in g/hour |
|---|---|
| Zero | Compressed and adhered to become massive |
| 1 to 6 | Zero to 0.34 |
| 6 and more | 3.2 to 4.3 |

The results show that the preferred distance l is from 1 to 6. Where $l<1$ mm; i.e., where partition plate 30 is disposed above in very close proximity to the upper end of area M, developer is stuffed in between concavely curved edge 30a of partition plate 30 and the surface of rotary sleeve 92 and is compressed to become massive as the rotary sleeve 92 rotates. The resulting massive developer is broken by some shock to become fragmentary pieces which get into developer chamber 93 to be mixed in the developer therein. The pieces, when transported into between first regulating plate 27 and the surface of the rotary sleeve, hinder the height control action of the control plate, whereby the hindered portion alone of the developer layer lacks its height, thus causing an undeveloped blank area in the developed image. It is needless to say that this defect is a death-blow to reproduced copies. On the contrary, where $l > 6$ mm, i.e., where partition plate 30 is disposed fairly spaced from the end of area M, the quantity of developer leaking through the gap between partition plate 30 and the surface of rotary sleeve 92 quickly increases to cause a large leakage, so that the usable efficiency of the developer is significantly lowered because the loss of from 3 to 4 grams per hour of developer by leakage is as much a quantity as corresponding to the whole quantity of the toner contained in 100 grams of a two-component developer.

The present invention has thus been illustrated with reference to a rotary sleeve type magnetic brush developing means, but the present invention may be applied in quite the same way to rotary magnet type magnetic brush developing means, and further may of course be applied to not only one that has its developer chamber provided on the side of the rotary sleeve but also another having its developer chamber provided below the rotary sleeve, which type is seen frequently in copying apparatus using two-component developer. In the foregoing example, partition auxiliary members and auxiliary regulating plates were employed because of problems in the mass production, but should the gap between the partition plates, the wider width portions of the regulating plates and the surface of the rotary sleeve be produceable with a high yield in 0.35 mm or smaller, the use of these auxiliary members and auxiliary regulating plates are unnecessary.

According to the present invention, in magnetic brush type developing apparatus, the increase in load against the rotation of the rotary sleeve and the burning of the rotative axis thereof caused by the increasing load brought about by the intrusion of developer particles into the sleeve or into the rotative bearings of the group of magnets can be prevented by providing the partition plates in the proximity of both longitudinal ends of the sleeve, and further, the leakage of developer may be largely reduced by setting the gap between the partition plates and the surface of the sleeve and the gap between the regulating plates and the surface of the sleeve to be 0.35 mm or smaller. And the leakage of developer may be further reduced by disposing the partition plates spacing apart within the range of from 1 to 6 mm from the end of the magnetic toner attaching area of the sleeve. Further, the rise of developer at both side ends thereof after being controlled by the earing control plate is completely prevented. Thus, the present invention solves the problems on developer arising in magnetic brush developing apparatus with the use of simple composition means.

What is claimed is:

1. In an electrophotographic copying machine having a movable photosensitive member and a magnetic brush developing device in juxtaposition to said photosensitive member for transporting and applying developer thereto, said developing device comprising a housing having a developing chamber for storing developer, developing means mounted in said chamber comprising a cylindrical sleeve formed of nonmagnetic material, a plurality of radially spaced magnets positioned within said sleeve and extending along the central axial section thereof, and means mounting said sleeve and said axially spaced magnets for relative rotation adjacent said photosensitive member, whereby said magnets cause adherence of developer to said sleeve for transport from said chamber toward said photosensitive member, and a regulating plate positioned adjacent said chamber and having an edge extending axially across and adjacent to the surface of said sleeve at a predetermined distance therefrom to regulate the thickness of the adhering developer coming from said chamber, the improvement comprising a second regulating plate having an edge extending axially across and adjacent to the surface of said sleeve at a predetermined distance therefrom, and means mounting said second plate relative to said sleeve downstream of said first plate and immediately before the juxtaposition of said sleeve and said photosensitive member to recontrol the thickness of the adhering developer, and in which the outer edges of at least one of said plates opposite the respective outer edges of said sleeve are substantially wider and closer to said sleeve than the center sections of said plates, whereby spreading and swelling of the developer at the outer edges of said sleeve is prevented.

2. In an electrophotographic copying machine according to claim 1 in which said photosensitive member is a drum.

3. In a copying machine according to claim 2, the improvement comprising positioning the widened edges of said regulating plates at a distance no greater than 0.35 mm from the surface of said sleeve.

* * * * *